United States Patent [19]

Hartke

[11] Patent Number: 5,065,966

[45] Date of Patent: Nov. 19, 1991

[54] PORTABLE HOLDER TO SUPPORT A RECAPPED CONTAINER OF EFFERVESCENT LIQUID IN AN INVERTED POSITION TO RETAIN THE LIQUID'S FRESHNESS

[76] Inventor: Dennis V. Hartke, 4825 Mill Pond Loop, Auburn, Wash. 98002

[21] Appl. No.: 461,683

[22] Filed: Jan. 8, 1990

Related U.S. Application Data

[63] Continuation of Ser. No. 277,360, Nov. 28, 1988, Pat. No. 4,960,254.

[51] Int. Cl.[5] ..... A47G 23/02

[52] U.S. Cl. ..... 248/146; 248/311.3; 211/74

[58] Field of Search ..... 248/146, 311.3; 211/71, 211/74, 59.4

[56] References Cited

U.S. PATENT DOCUMENTS

| | | | |
|---|---|---|---|
| 1,672,033 | 6/1928 | Mallins | 248/146 X |
| 1,922,127 | 8/1933 | Foley | 248/146 X |
| 2,363,474 | 11/1944 | Schlesinger | 248/146 X |
| 2,372,872 | 4/1945 | Wolper | 248/146 X |
| 2,574,270 | 11/1951 | Leonard | 248/146 |
| 2,780,081 | 2/1957 | Alexander | 248/146 X |
| 3,480,152 | 11/1969 | Walsh | 211/74 |
| 3,642,239 | 2/1919 | Zeiler, Jr. | 248/146 X |
| 4,418,883 | 12/1983 | Cohen | 248/205.1 X |

*Primary Examiner*—Blair M. Johnson

[57] ABSTRACT

A holder, in various embodiments, holds a previously opened, now recapped, bottle, partially filled with an effervescent liquid, in an inverted position. The effervescent liquid forms a gas seal about the interior of the replaced cap, where the vertical supports that stabilize the container in the inverted position are sized and positioned specifically about the holder to allow the holders with the containers therein to be stacked for storage, transporting or display wherein, the column strength for supporting the upper tier of containers is supplied by the container and not by the vertical supports of the holders. In some embodiments, an associated liquid drip basin portion of the holder is included to collect some possible seepage when used for inverted support of a recapped container and also serves as a stabilizing platform for stabilizing the upper tier of containers when stacked for storage, transporting or display.

4 Claims, 10 Drawing Sheets

VIEW-A-A

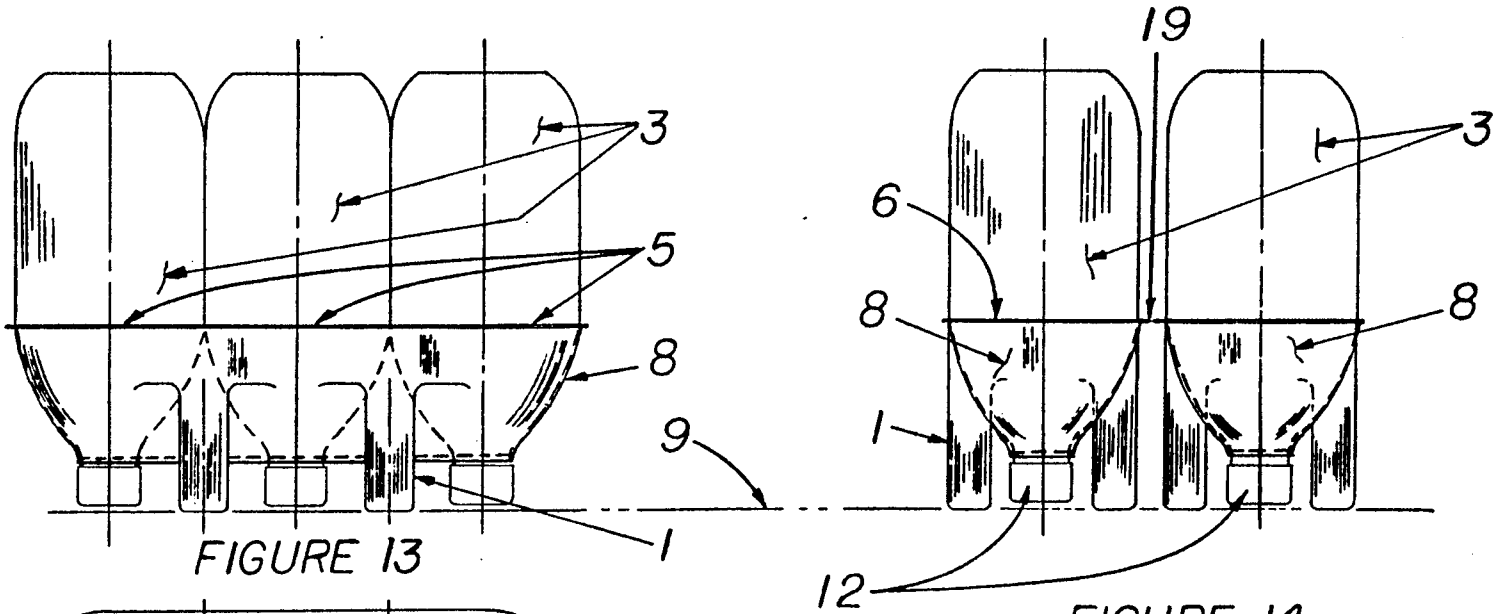
FIGURE 14
FIGURE 13
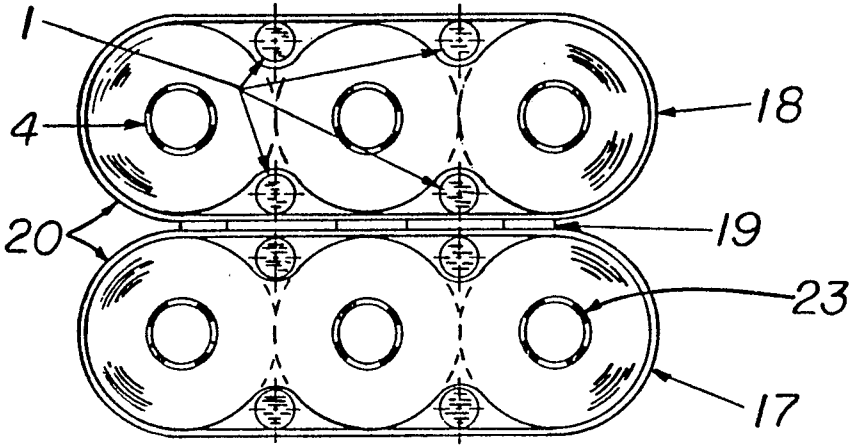
FIGURE 15

PORTABLE HOLDER TO SUPPORT A RECAPPED CONTAINER OF EFFERVESCENT LIQUID IN AN INVERTED POSITION TO RETAIN THE LIQUID'S FRESHNESS

CROSS REFERENCE

This application is a continuation in part application filed while the application S/N 07/277360 filed Nov. 28, 1988, now U.S. Pat. No. 4,960,254. Both of these applications have the same title *A Portable Holder to Support a Recapped Container of Effervescent Liquid in an Inverted Position to Retain the Liquids Freshness,* and Dennis V. Hartke is the applicant of both applications.

TECHNICAL FIELD

The invention relates to a container holder for storing resealed containers having effervescent liquid therein, wherein the container holder can also be used for transporting, and container display purposes.

BACKGROUND ART

There have been many advances in the art of bottling, capping, and sealing of containers. There has not however ever been an effective method of resealing opened bottles having effervescent liquid therein, using the original cap. Threaded caps are used extensively in the capping of containers having effervescent liquid inside, and are very effective on the first seal, however after the container is opened, the effervescent liquid therein begins to loose its "fizz" due to the loss of gas. By replacing the cap, the escapement of gas is slowed but not stopped due to the continued escapement of gas past the now unsealed, but replaced cap. Racks or container supports for supporting bottles are known in the art, most particularly for wine bottles. These racks or supports ordinarily support the bottle if sealed with a cork in a mostly horizontal position with the liquid therein in contact with the cork, to insure that the cork remains moist, because a dried-out cork is difficult to remove and/or may crack during removal. However, in the past, if the bottle has been sealed with a threaded cap or a cap other than a cork, it is racked or supported in a manner that will prevent the liquid from coming in contact with the cap to prevent leakage. However, the shelf life of an opened then recapped container of effervescent liquid stored in this "prior art" position, is limited to hours, due to continued gas escapement.

The prior art devices for supporting containers in the mostly horizontal position are not suitable for supporting "state of the art" effervescent liquid containers because of their size and shape. There is also great emphasis in todays market for compactness, ease of product display, attractiveness of product displays, and the ability to ship product easily. None of these desired qualities are found in the prior art devices, designed for inverted container support. The prior art container supports were also not designed for storage in the conventional refrigerator.

SUMMARY

It is the object of the present invention to provide a means for stacking, and/or storing resealed containers having effervescent liquid therein in an inverted position, and is designed for use in conventional coolers or refrigerators. It is a further object of this invention to provide a means for stacking, transporting and/or otherwise displaying the container holder with the container therein, wherein the column strength for supporting an upper tier of container holders with containers therein, is provided by the container in the lower tier, and does not rely on the container holder to provide column stacking strength. It is a further object of this invention to provide an associated liquid collecting device to be used to collect any seepage of liquid past the cap when used in association with the container holder when supporting the container in the inverted position. The liquid collecting device is also used as a stabilizing platform for stacking, transporting and/or otherwise displaying the container holder with containers therein.

The invention is comprised of a container holder having a central top opening to receive the exterior of a container which can be lowered into the opening so the container will become stable when inserted into the container holder in an inverted position. The container is stabilized in the inverted position by means of vertical side supports of the container holder. There is also an associated liquid collection device for stabilizing the containers and container holders when stacked for display or transporting, and for collecting liquid seepage from the cap when used for inverted storage.

Container holders for supporting containers in the inverted position for various reasons has been known for many years. This method of storage has been used mostly for the storing of wine bottles having cork closures, or for supporting containers having viscous content, to allow the contents to drain into other containers. The container holders of this prior art were designed for inverted supporting of containers only, and does not address present day marketing, transporting, and instore display stacking requirements. They were designed with "after market sales" in mind. I feel my device addresses beverage freshness, as well as the product marketing, transportation and instore display needs of today.

DRAWINGS

The various embodiments of this holder to support a previously opened effervescent liquid container partially emptied and recapped in an inverted position to retain freshness, as well as embodiments showing the stacking features of the holder and the stabilizing features of the holder are illustrated in the drawings wherein.

Figure 4:
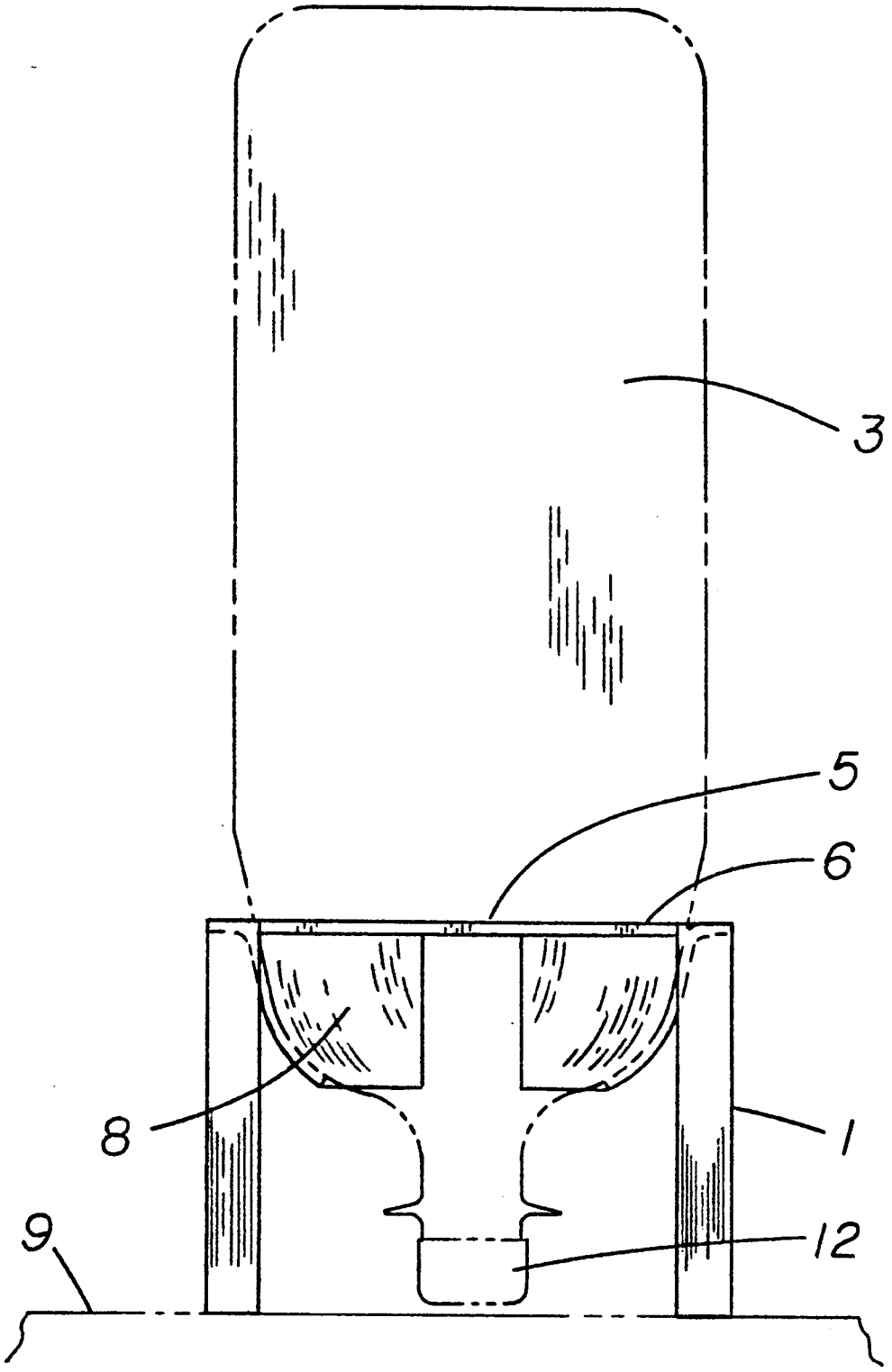
FIG. 4 is a front view of a second species of holder of the present invention showing the vertical support options of this species.
Figure 5:
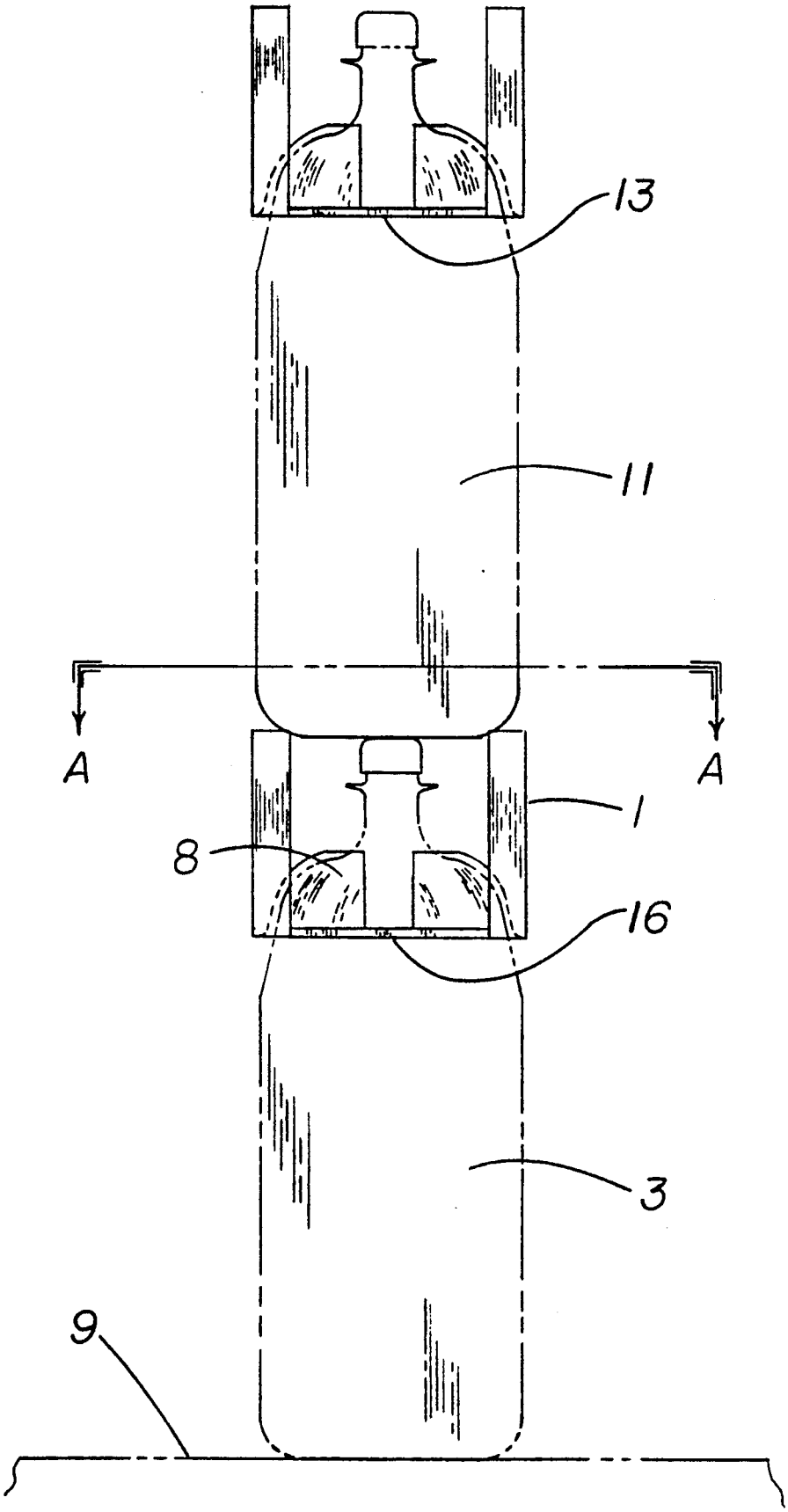
FIG. 5 is a front view of the same species of holder as in FIG. 4, showing how the described stacking features apply in various species.
Figure 6:
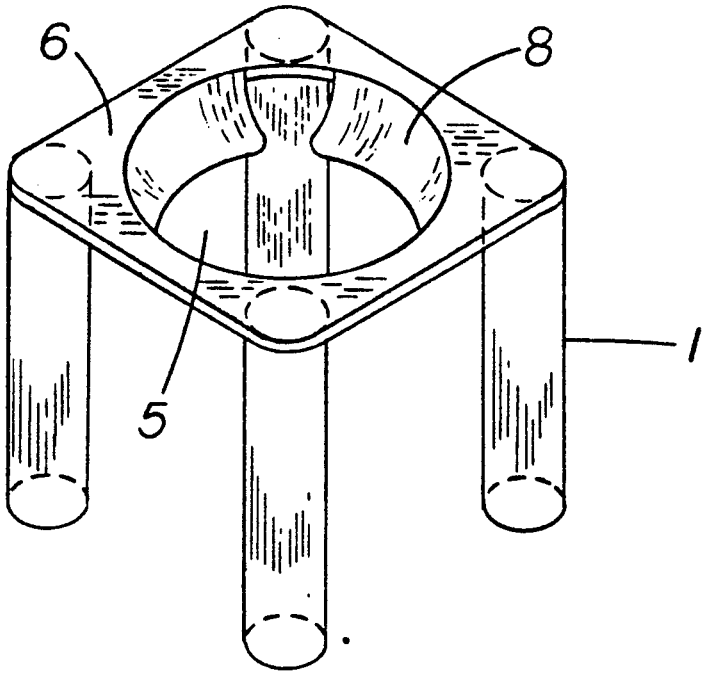
FIG. 6 is a perspective view of the species of holder shown in FIGS. 4 and 5.

FIGS. 13, 14, and 15 show a front, end and bottom view respectively of a holder of the same species as FIGS. 4, 5, and 6 showing a holder supporting multiple containers in the inverted position.

Figure 17:
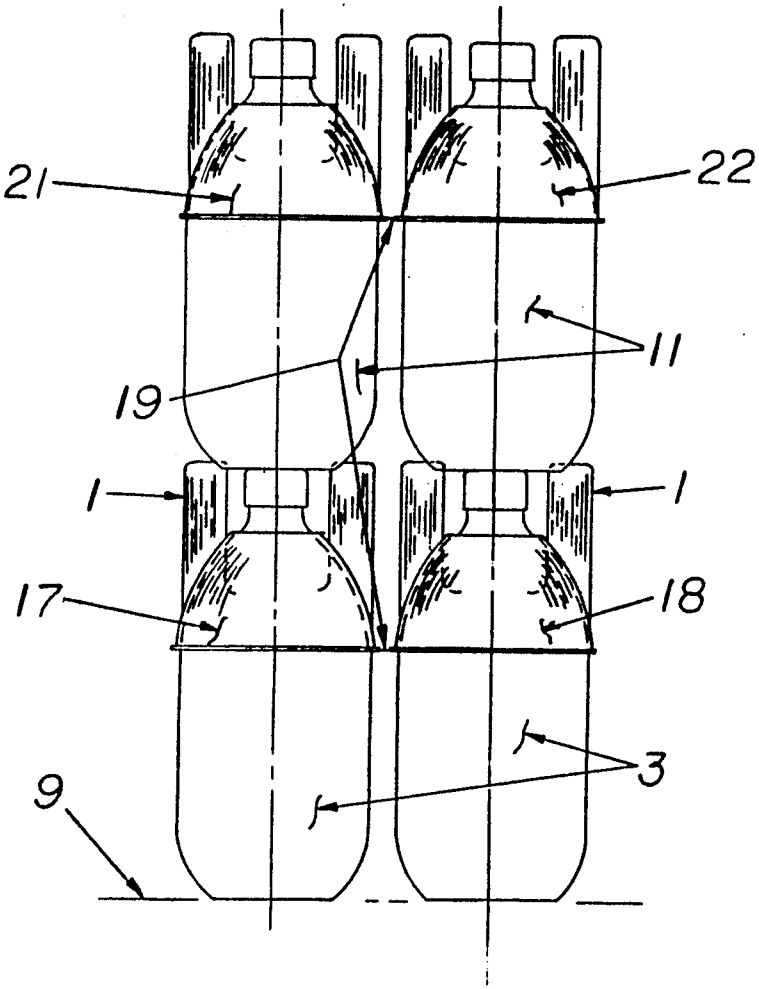
Figure 16:
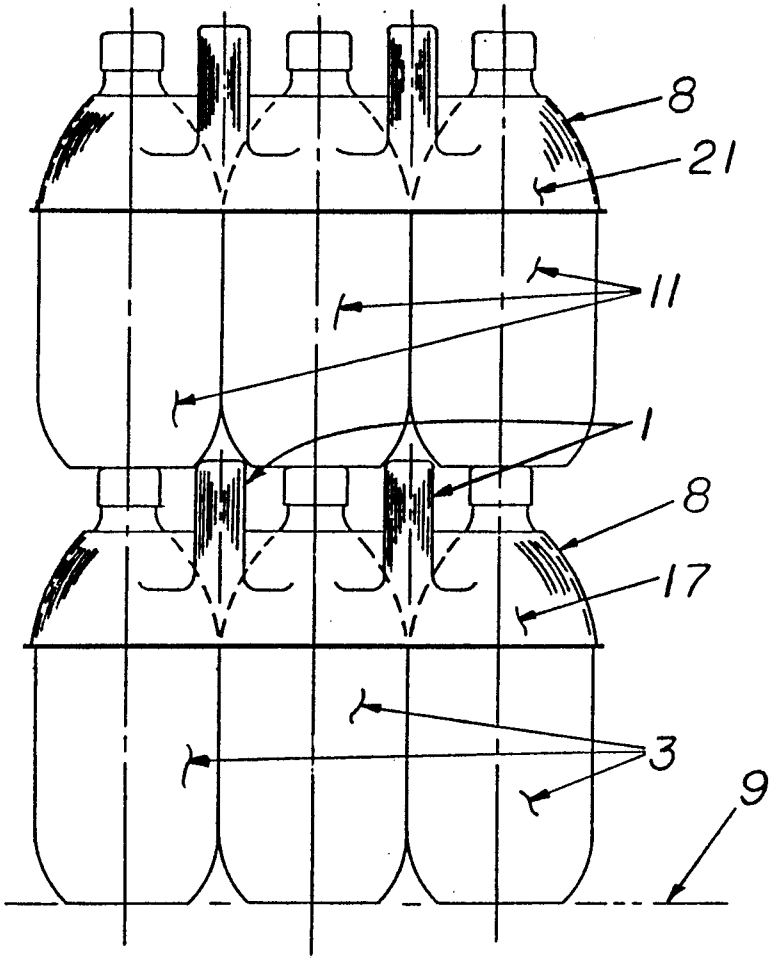

FIGS. 16 and 17 show front and end views respectively of a multiple container holder, shown in FIG. 13 through 15, illustrating its stacking feature.

DESCRIPTION OF THE PREFERRED EMBODIMENT

Figure 1:
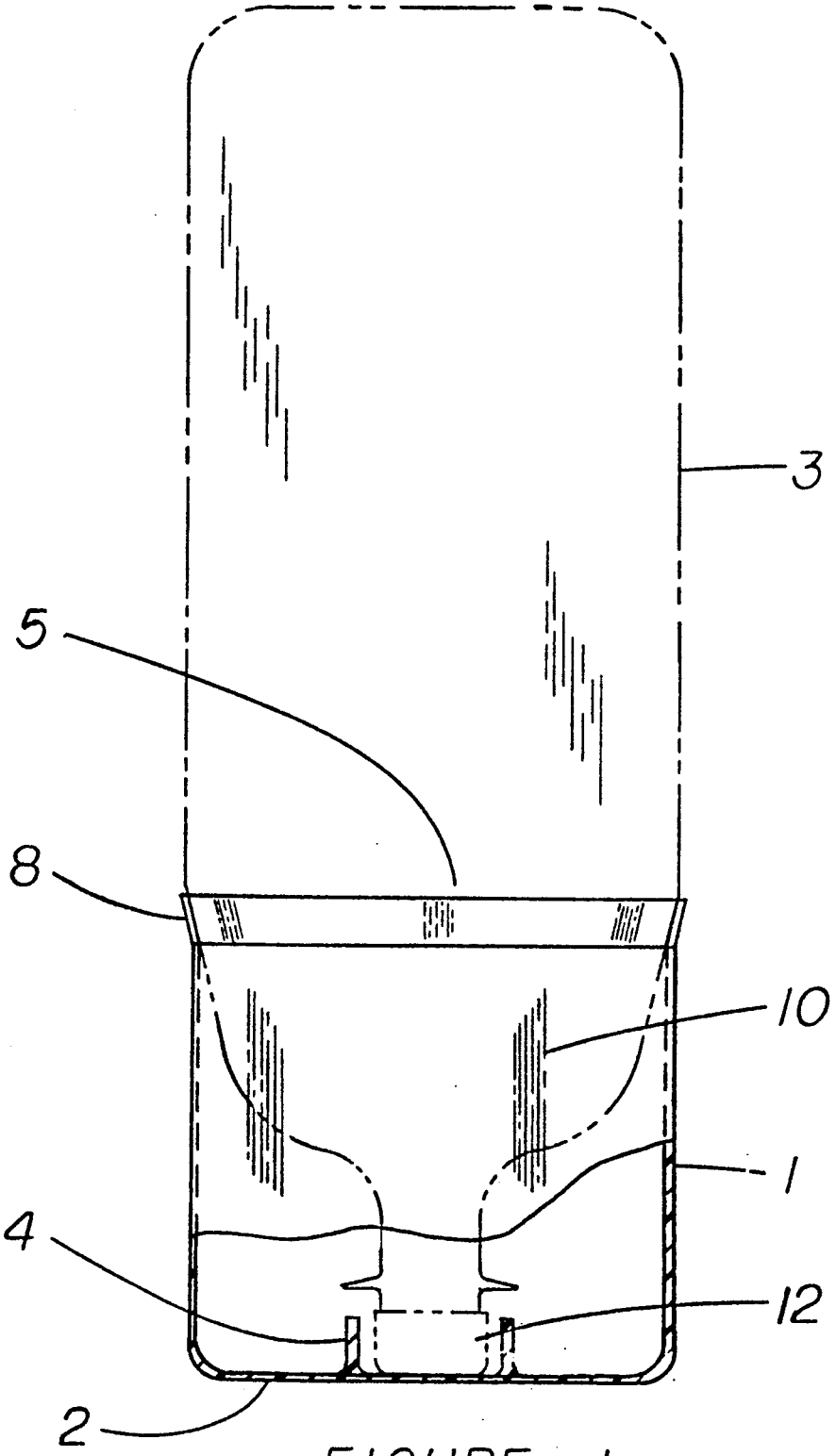
FIG. 1 is a front view of a species of a holder of the present invention, showing the holder as it would support a recapped bottle to preserve its freshness.
Figure 9:
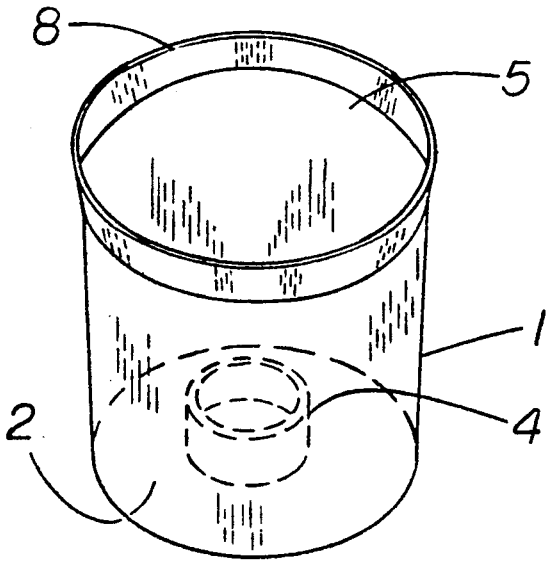
FIG. 9 is a perspective view of the same species of container holder as shown in FIGS. 1 and 2.

The container holder of the present invention is comprised of vertical supports (1), a central top opening (5), large enough to receive the exterior of a container, and a base (2). As shown in the species in FIGS. 1 and 9, the vertical supports (1) form a central top opening (5), and formed pocket (8) for supporting the container (3) in the inverted position. In this species the cap of the container (12) rests on the base (2), which is perpendicular to the vertical supports (1). In this species the vertical supports do not support the weight of the container (3), they are used only to stabilize the container (3) in the inverted position. The vertical supports (1), the formed pocket (8), and base (2) are integral parts and form a liquid collector and container holder (10). Attached to the base (2) is a centering ring (4) used to assist in the locating of the container (3) as well as to stabilize the container within the holder, and stabilize the base (2) when the container holder (10) is used for stacking as shown in FIG. 2 and FIG. 3.

Figure 2:
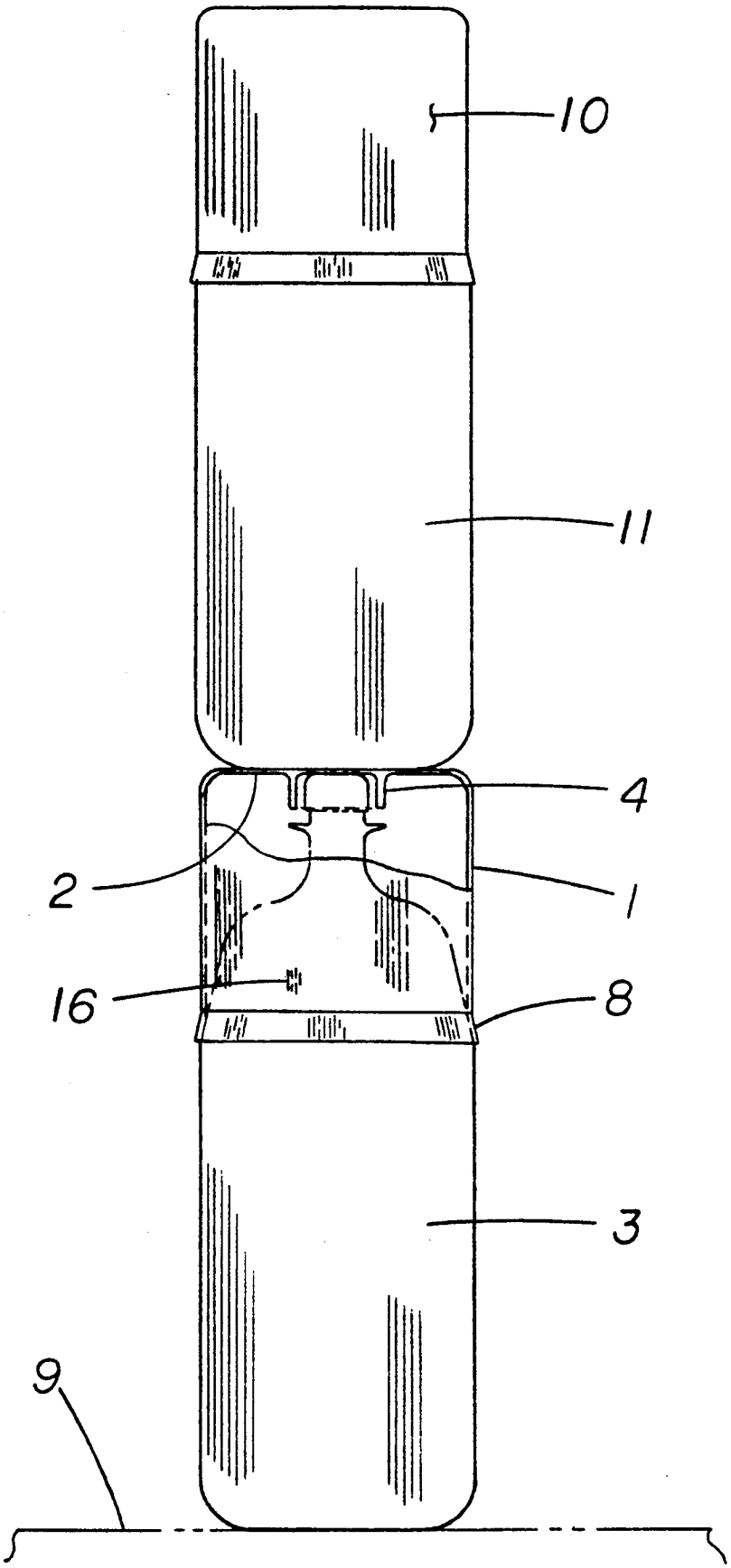
FIG. 2 is a front view of the same species of holder as FIG. 1 showing the preferred stacking features and stabilizing features of the holder with the associated liquid collector of the present invention.

FIG. 2 illustrates the stacking features of the present invention, and stabilizing platform feature of the base (2) of the container holder (16). The container (3) is positioned in an upright position and resting on a base (9), a container holder (16) is then positioned on top of the container (3). With the container (3) and a container holder (16) placed as described, additional containers (11) can be stacked on top of the lower container holder (16) with container (3) therein. With the two containers (3) and (11) and holders (16) and (10) stacked as shown in FIG. 2, it is illustrated that the weight of the container (11) in the upper tier is supported completely by the container (3) in the lower tier. The vertical supports (1) of the container holder (16) do not supply any of the column strength for supporting the upper tier. The base (2) of the liquid collector act as a stabilizing platform for the upper container (11). The centering ring (4) assures proper positioning between the lower container (3), the lower container holder (16) and the upper container (11), to insure stacking stability.

Figure 3:
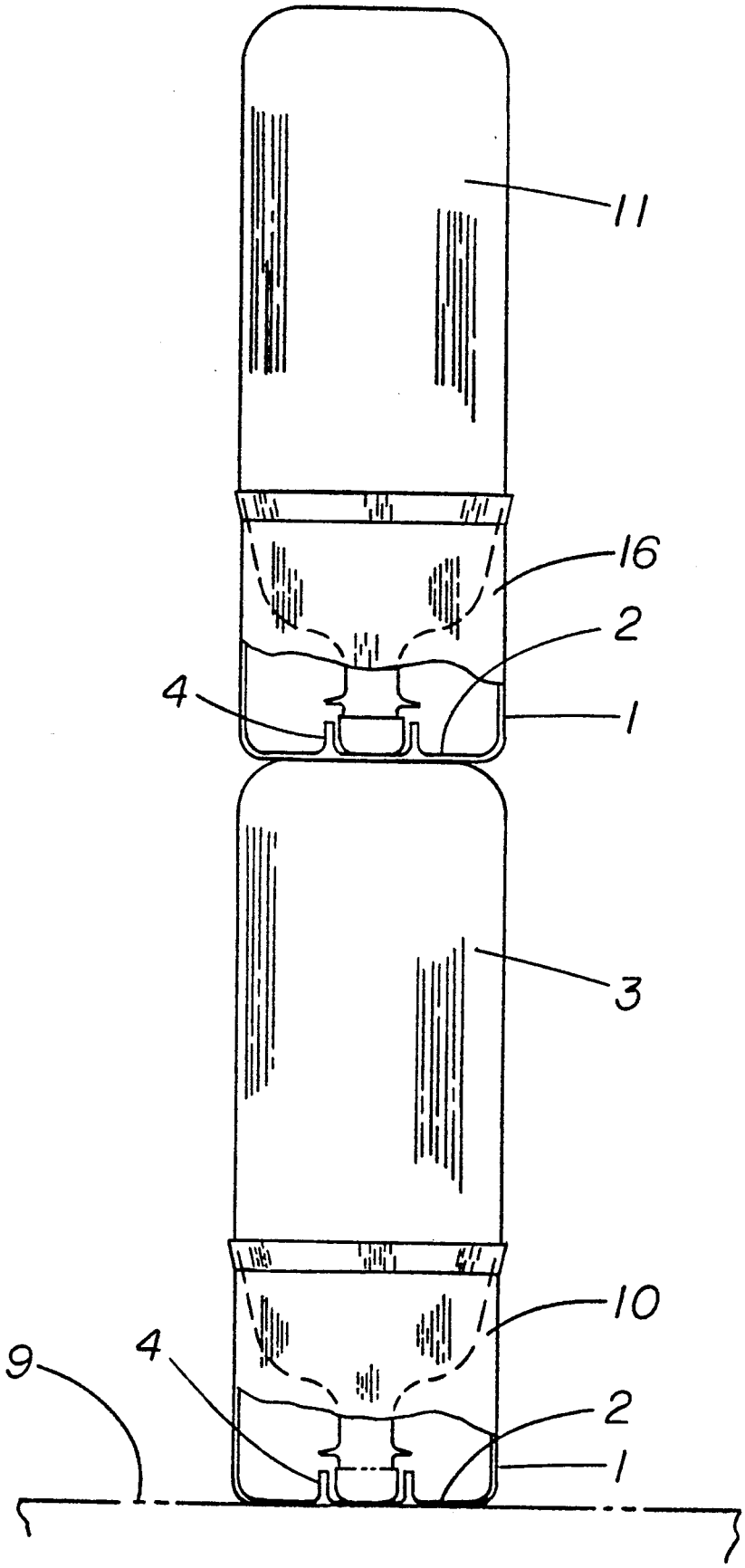
FIG. 3 is a front view of the same species of holder as FIG. 1, showing the alternate stacking features, and stabilizing features of the holder with the associated liquid collector of the present invention.

FIG. 3 illustrates the stacking features of this species of the present invention and stabilizing platform features of the base (2) when the containers (3) and (11) are stacked in the inverted position, where the container (3) is positioned into the container holder (10) in the inverted position, and the container holder (10) is placed on a base (9). With container (3) and holder (10) positioned as described, additional container holders (16) with container (11) therein can be stacked on top of the lower container (3). With the two containers (3) and (11) stacked as shown in FIG. 3, it is illustrated that the column strength required for supporting the weight of the container (11) and holder (16) in the upper tier is supplied completely by the container (3) in the lower tier The vertical supports (1) on container holder (10) and (16) do not supply any of the column strength for supporting the upper tier. The base (2) of the container holder (10) and (16) act as a stabilizing platform for stabilizing the containers (3) and (11). The centering ring (4) assures proper positioning between the container holders (10) and (16) and the containers (3) and (11) therein to insure stacking stability.

A second species of holder is shown in FIGS. 4 and 6. This species consists of four vertical supports (1), a formed pocket (8), a central top opening (5) and a top portion (6). As shown in FIG. 4, the container (3) is lowered into the central top opening (5). The container rests, in the inverted position, in the formed pocket (8). The cap (12) of the container (3) is supported above the base surface (9). This species requires the weight of the container (3) to be supported by the vertical supports (1) of the holder, when this species is used for supporting the container (3) in the inverted position.

The upright stacking features of this species of the present invention is illustrated in FIG. 5. The container (3) is placed in an upright position on base (9). The container holder (16) is placed on the lower container (3). With the container holder (16) placed on the lower container (3) additional containers (11) can be stacked on top of the lower container (3). When containers (3) and (11) are stacked in the upright position, the weight of the upper container (11) and holder (13) is supported completely by the lower container (3). The vertical supports (1) of the lower container holder (16) do not supply any column strength for supporting the upper tier of containers or holders.

Figure 8:
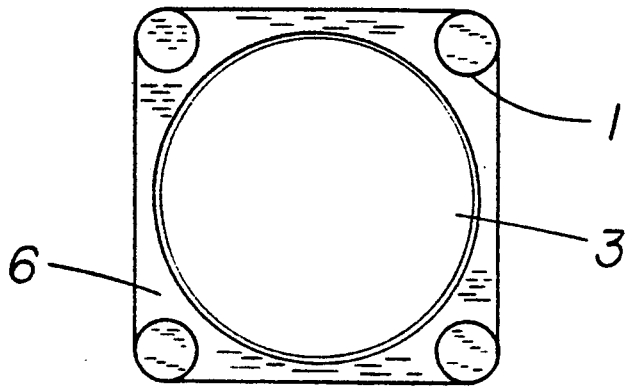
FIG. 8 is a section view through FIG. 5 illustrating the congruous locations of the vertical supports which allows for the stacking of containers wherein the vertical supports for supporting the container in the inverted position are not used for strength or support when containers are stacked in the upright position.

Length restrictions and congruent positioning of the vertical supports (1) about the container (11) shown in FIGS. 4, 5, and 8 prevent the vertical supports (1) from supplying any of the column strength for supporting the upper tier of containers and holders.

Figure 7:
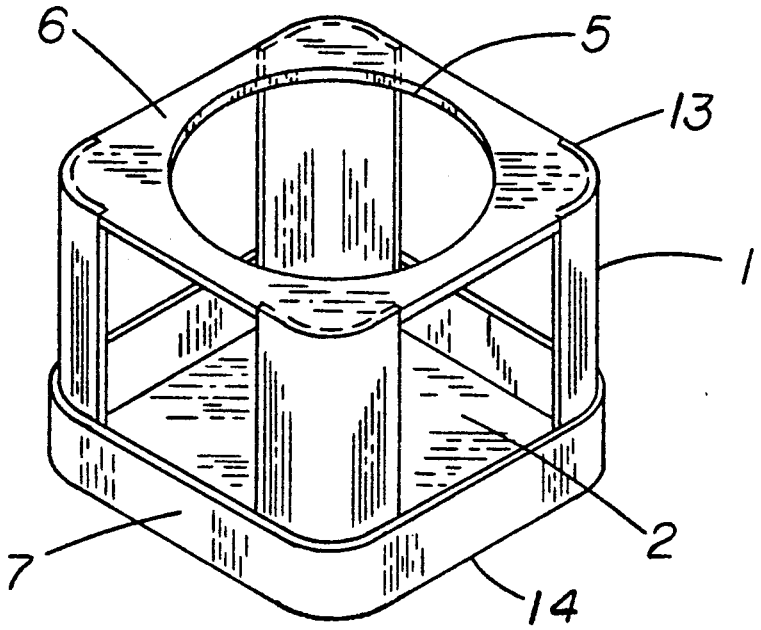
FIG. 7 is a front view of a third species of holder of the present invention, showing an independent liquid collector used in conjunction with an inverted container holder.

A third species of the present invention is shown in FIG. 7. This species of the present invention consists of four vertical supports (1), a top portion (6) with a central top opening (5). This species has an associated liquid collector (14) consisting of a base (2) and peripheral flange (7). This species is used identically to that of FIG. 11, and will have the same stacking characteristics as the species shown in FIGS. 2 and 3. In this species the liquid collector (14) is formed by a base (2) and peripheral flange (7) and are integral parts. The liquid collector (14) is not however integral with the vertical supports (1), although the liquid collector (14) is attached to the vertical supports (1) by an attaching means. The liquid collecting unit (14) is associated with and used in conjunction with the container holder (13) for both inverted storage and for stacking.

When this species of the present invention is used for stacking in the upright position, it will use the base (2) of the liquid collector (14) as a stabilizing platform for stabilizing the upper tier of container (11) as shown in FIG. 2 and FIG. 3. This species will also utilize the weight supporting characteristic of the lower container (3), wherein the vertical supports (1) will not support any of the weight or column load of an upper tier, as in FIGS. 2 and 3.

Figure 10:
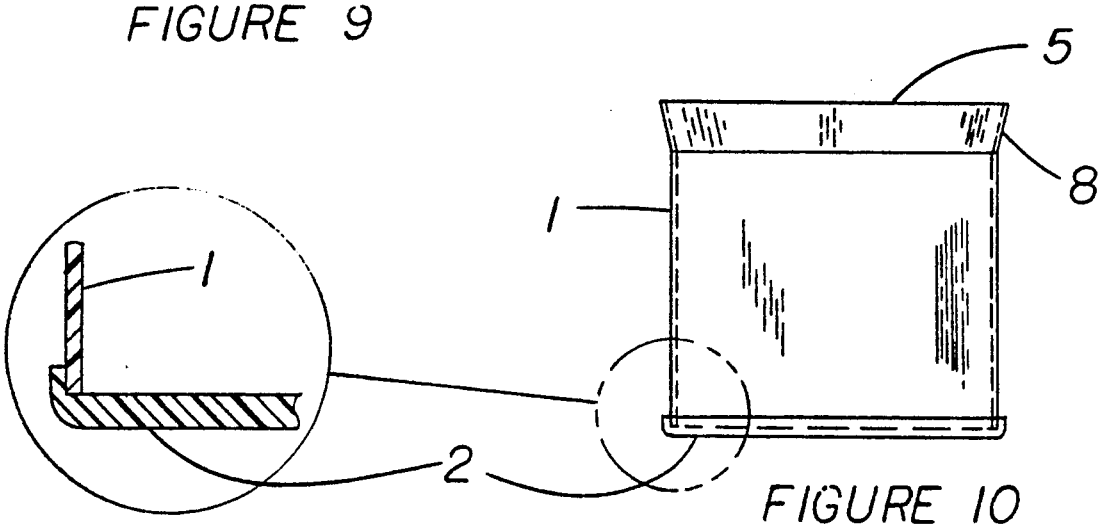
FIG. 10 is a front view of a fourth species of holder, of the present invention similar to the species shown in FIGS. 1, 2, and 9. This species has an independent base used in conjunction with the vertical supports.

A fourth species of the present invention is shown in FIG. 10. This species consists of vertical supports (1), a formed pocket (8), a central top opening (5), and a detachable base (2). In this species the vertical supports (1) form the central top opening (5) and formed pocket (8). The base (2) is attached, by an attaching means (15), to the vertical supports (1). With the base (2) attached to the vertical supports (1), the base (2) and vertical supports (1) form a liquid collector.

This species utilizes the same stacking, weight supporting and stabilizing platform characteristics as the species shown in FIG. 1, FIG. 2, FIG. 3, and FIG. 9.

Figure 11:
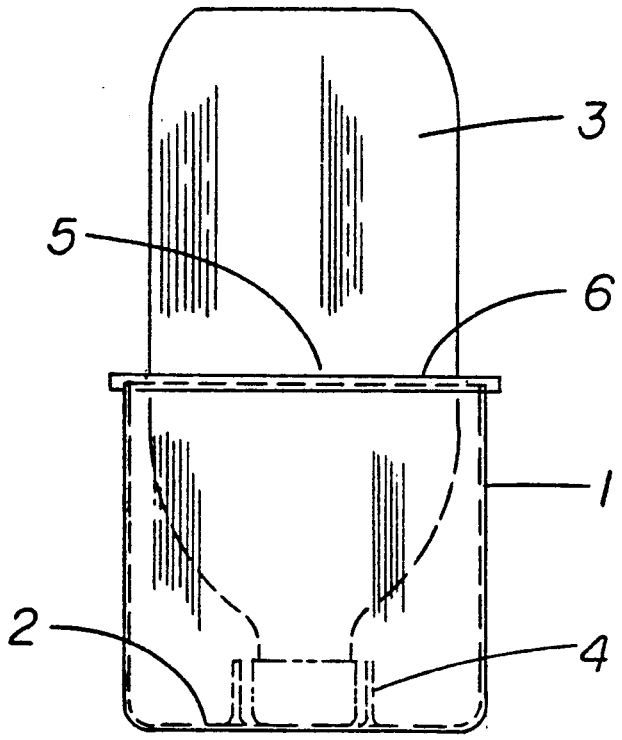
FIG. 11 is a front view of a fifth species of holder of the present invention.
Figure 12:
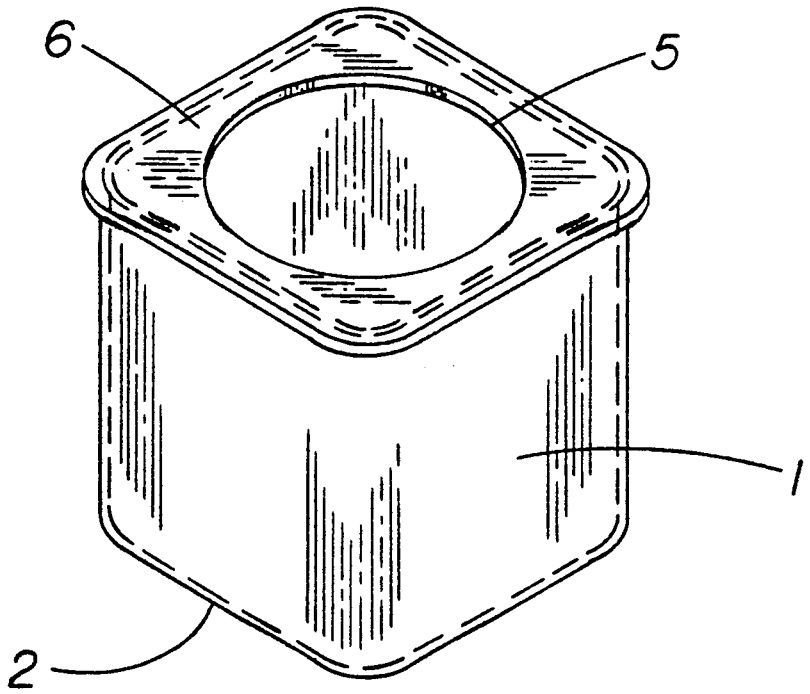
FIG. 12 is a perspective view of the species of holder as shown in FIG. 11.

A fifth species of the present invention is shown in FIGS. 11 and 12. This species consists of vertical supports (1), a base (2), a top portion (6), a central top opening (5), and a centering ring (4). The vertical supports (1) and base (2) are integral parts and form a liquid collector. The top portion (6) is secured to the vertical supports (1) by an attaching means. The central top opening (5) is in the top portion (6). This species has the centering ring (4) attached to the base (2) to assist in the positioning and stabilizing of the container (3).

This species utilizes the same stacking, weight supporting, and stabilizing platform characteristics as the species shown in FIG. 1, FIG. 2, FIG. 3, and FIG. 9.

The species of the present invention shown in FIGS. 13, 14, and 15 supports the inverted container (3) in the same manner and is of the same species of holder as shown in FIGS. 4, 5, and 6, and illustrate the ability to make holders capable of supporting multiple containers in the inverted position, by connecting or combining two or more container holders (17) and (18) together. This holder is comprised of vertical supports (1), a formed pocket (8), multiple central top openings (5), and a top portion (6). The containers (3) are lowered into the central top opening (5), and rests in the formed pocket (8). The caps (12) of the containers (3) are supported above the base surface (9). This requires the vertical supports (1) to support the weight of the containers (3) when used for supporting the container (3) in the inverted position. These figures further illustrate the joining of two portable holders (17) and (18) through the means of connecting tabs (19) attached to the holders (17) and (18), thus forming a larger unit (20). The larger container holder (20) can also be separated into the smaller container holders (17) and (18) by separating either container holder (17) or (18) from the connecting tabs (19).

This species of container holder also provides for a centering ring (4) to assist in the location of the containers (3) and to stabilize the containers (3) within the holders (17) and (18). The centering ring (4), shown in FIG. 15 also provides for a clasping mechanism (23) for securing the containers within the holder for transporting or storage. The centering ring (4) shown in this figure is an integral part of the formed pocket (8).

FIGS. 16 and 17 illustrate the upright stacking features of the multiple unit container holder (17) and (18). The containers (3) are set in the upright position on a base (9) with the holders (17) and (18) positioned on the containers (3), the containers (3) resting in the formed pockets (8). With the containers (3) positioned as described, additional containers (11) can be stacked on top of the lower containers (3), wherein the weight of the upper tier of containers (11) and holders (21) and (22) is supported completely by the containers (3) in the lower tier. The vertical supports (1) of the lower container holder (17) and (18) do not supply any column strength for supporting the upper tier of containers (11) or holders (21) and (22).

Length restrictions and congruent positioning of the vertical supports (1) about the containers (3) prevent the vertical supports (1) of the holders (17) and (18) from supplying any of the column strength for supporting the upper tier.

I claim:

1. A portable holder in combination with a previously opened, capped container of effervescent liquid partially emptied and recapped, said holder supporting said container in an inverted position, whereby, remaining effervescent liquid therein is forced into contact about the interior of the replaced cap causing the liquid to form a seal between the cap and container to prevent the escapement of gas from the container, said combination, comprising:

a surrounding hollow upright body, consisting of a base portion, and a peripheral flange which forms a vertical support means extending upwardly from the said base portion, forming a top opening receives an inverted container, and limits the lateral movement of said inverted container, wherein, the said vertical supports extend upwardly from the said base portion a distance at least equal to the farthest distance the inverted container must protrude through the said top opening to stabilize the container in the inverted position, wherein, the said vertical support means, in combination with the said base portion, form a drip basin for collecting any liquid that may seep past the replaced cap while storing the container in the inverted position, wherein, said surrounding hollow upright body (A portable holder as claimed in claim 13, wherein said base portion of said portable holder) has a positioning aperture therein, (wherein, the said positioning aperture, in said base portion, is) comprised of an annular flange extending from the said base portion a distance at least equal to a distance required for the cap end of said container to be received into the said annular flange, said annular flange being spaced inwardly on said base from said peripheral flange, said annular flange forms a means for limiting the lateral movement of the cap end of said inverted container, wherein, the said positioning aperture, in combination with said vertical support means, assists in maintaining the containers substantially vertical position.

2. A portable holder as claimed in claim 1, wherein, the said base portion of said portable holder forms a substantially horizontal platform when said portable holder is positioned on a non-inverted container, wherein, the said positioning aperture, (in said base portion) of said portable holder, in combination with said vertical support means, positions and maintains the said base portion of said portable holder in a plane substantially perpendicular to the container therein, wherein, the said base portion of said holder forms a substantially horizontal platform, whereon, an additional container can be vertically stacked, wherein, the said substantially horizontal base forms a stabilizing platform for supporting an upper tier of containers, wherein, said portable holder is usable in combination with un-opened containers for stacking during shipping, storage, or displays.

3. A portable holder as claimed in claim 2 wherein, the said top opening (to receive and stabilize said inverted container) formed by said vertical support means extends upwardly from said base portion, and is of such effective circumference that the cap end of the inverted container contacts said base portion of said holder, wherein the weight of said container, and content therein, is supported by said base portion of said holder, wherein said vertical support means of said portable holder does not support the vertical weight of the said container, or content therein.

4. A portable holder as claimed in claim 1, wherein, the said annular flange of said positioning aperture, is an integral part of said base portion and forms a drip basin for collecting any liquid that may seep past the cap while storing said container in the inverted position.

* * * * *